US008371871B1

(12) United States Patent
Murphy

(10) Patent No.: US 8,371,871 B1
(45) Date of Patent: Feb. 12, 2013

(54) TERMINAL WITH COMPLIANT BARB

(75) Inventor: Michael J. Murphy, East Greenwich, RI (US)

(73) Assignee: Advanced Interconnections Corp., West Warzick, RI (US)

( * ) Notice: Subject to any disclaimer, the term of this patent is extended or adjusted under 35 U.S.C. 154(b) by 0 days.

(21) Appl. No.: 13/207,497

(22) Filed: Aug. 11, 2011

(51) Int. Cl.
*H01R 4/24* (2006.01)

(52) U.S. Cl. ..... 439/444; 439/733.1

(58) Field of Classification Search ..... 285/334.5
See application file for complete search history.

(56) References Cited

U.S. PATENT DOCUMENTS 4,139,255 A 2/1979 Otani
4,841,100 A 6/1989 Ignasiak
4,887,981 A * 12/1989 Damon et al. ..... 439/885
4,913,286 A * 4/1990 Tate ..... 206/728
5,391,088 A 2/1995 Tomchak et al.
5,984,735 A * 11/1999 Daoud ..... 439/733.1
6,352,437 B1 3/2002 Tate
6,809,537 B2 10/2004 Adams
7,255,612 B2 8/2007 Noguchi
7,604,517 B2 * 10/2009 Hsieh et al. ..... 439/733.1

* cited by examiner

*Primary Examiner* — Edwin A. Leon
*Assistant Examiner* — Harshad Patel
(74) *Attorney, Agent, or Firm* — Occhiuti Rohlicek & Tsao LLP

(57) ABSTRACT

An electrically conductive terminal is configured for insertion into an opening in a substrate. The terminal includes a body having proximal and distal ends. The distal end is configured for insertion into the opening. The body includes a wall having an outer surface and a compliant barb that includes a base portion, an apex portion, a barb inner surface, and a barb outer surface. The base portion is disposed on the outer surface of the wall, along the body. The apex portion extends from the base portion in a direction from the distal end to the proximal end at an angle from the wall outer surface. The apex portion is located between the base and the proximal end. The barb inner surface faces the wall outer surface. The barb inner surface and the barb outer surface converge to the apex so that the cross-sectional width of the barb is non-uniform.

14 Claims, 8 Drawing Sheets

220

520

602

702

802

TERMINAL WITH COMPLIANT BARB

BACKGROUND

Printed circuit boards (PCBs) are commonly used in electrical devices to support and connect electrical components such as integrated circuit chips, capacitors, resistors, and other electrical components. PCBs typically include an insulative material (e.g., glass fiber epoxy laminate) with conducting strips formed within or on the surface of (e.g., by etching) the insulative material. The conducting strips are patterned such that they interconnect various points on the PCB.

At each interconnected point, through holes are punched or drilled in the insulative material of the PCB. The inner surface of each hole is coated with a conductive material (i.e., plating) which is electrically connected to the conducting strip at the interconnected point. Electrical components are positioned in the through holes and an electrical connection between the through hole and the component is established, for example, by soldering the components within the through holes.

It is often desirable to have the ability to insert and remove electrical components from the through holes without the need to repeatedly solder and de-solder the through hole. For this reason, press-fit terminals are designed to be pressed into a through hole, thus fixing the terminal in the through hole and establishing an electrical connection with the conductive coating of the through hole using a compressive fit. The terminal can then used for repeated connections and disconnections of electrical components.

In some examples, the terminals include conductive barbs that press against the plating that coats the inner surface of the through hole when the terminal is pressed into the through hole. In this way, an electrical connection between the terminal and the plating is established.

SUMMARY

In an aspect, in general, an electrically conductive terminal for insertion into an opening of a substrate includes a body having a proximal end and a distal end, the distal end configured for insertion into the opening. The body includes a wall having an outer surface and a compliant barb. The compliant barb includes a base portion disposed on the outer surface of the wall and along the body, an apex portion extending away from the base portion in a direction from the distal end to the proximal end and at an angle from the wall outer surface, such that the apex is located between the base and the proximal end, a barb inner surface facing the wall outer surface, and a barb outer surface. When the barb is viewed in cross-section, the barb inner surface and the barb outer surface converge to the apex so that the cross-sectional width of the barb is non-uniform.

Aspects may include one or more of the following features.

The barb inner surface and the barb outer surface may be linear when viewed in cross section. The barb outer surface may be substantially linear and the barb inner surface may be substantially semi-circular when viewed in cross section. The barb may be annular. The terminal may include a plurality of discrete barbs along a circumference of the terminal. The terminal may include a pin portion formed on the proximal end. The terminal may include a pin portion formed on the distal end. The terminal may include a socket portion formed on the proximal end. The terminal may include a pin portion formed on the distal end.

In another aspect, in general, a terminal assembly includes a substrate, an opening in the substrate including an opening inner surface, and an electrically conductive terminal inserted into the opening of the substrate. The terminal includes a body having a proximal end and a distal end, the distal end configured for insertion into the opening. The body includes a wall having an outer surface and a compliant barb. The compliant barb includes a base portion disposed on the outer surface of the wall and along the body, an apex portion extending away from the base portion in a direction from the distal end to the proximal end and at an angle from the wall outer surface, such that the apex is located between the base and the proximal end, a barb inner surface facing the wall outer surface, and a barb outer surface. When the barb is viewed in cross-section, the barb inner surface and the barb outer surface converge to the apex so that the cross-sectional width of the barb is non-uniform.

Aspects may include one or more of the following features.

The barb outer surface may contact the opening inner surface, creating a compressive fit. The barb may be configured to create a compressive fit by conforming to the shape and dimensions of the opening inner surface.

In another aspect, in general, a method for forming a terminal including a compliant barb includes providing a portion of conductive material and forming the terminal by removing material from the portion of conductive material using a cutting tool. The terminal includes a body having a proximal end and a distal end. The body includes a wall having an outer surface and a compliant barb. The compliant barb includes a base portion disposed on the outer surface of the wall and along the body, an apex portion extending away from the base portion in a direction from the distal end to the proximal end and at an angle from the wall outer surface, such that the apex is located between the base and the proximal end, a barb inner surface facing the wall outer surface, and a barb outer surface. When the barb is viewed in cross-section, the barb inner surface and the barb outer surface converge to the apex so that the cross-sectional width of the barb is non-uniform.

Embodiments of the invention may have one or more of the following advantages.

Among other advantages, the use of compliant barbs reduces damage to through hole plating due to the barbs conforming to the diameter of the plating, insuring that a good electrical connection is formed between the terminal and through hole plating. This is an improvement relative to some conventional, non-compliant barbs which can scrape plating from the through hole during insertion.

Other features and advantages of the invention are apparent from the following description, and from the claims.

DESCRIPTION

Figure 1:
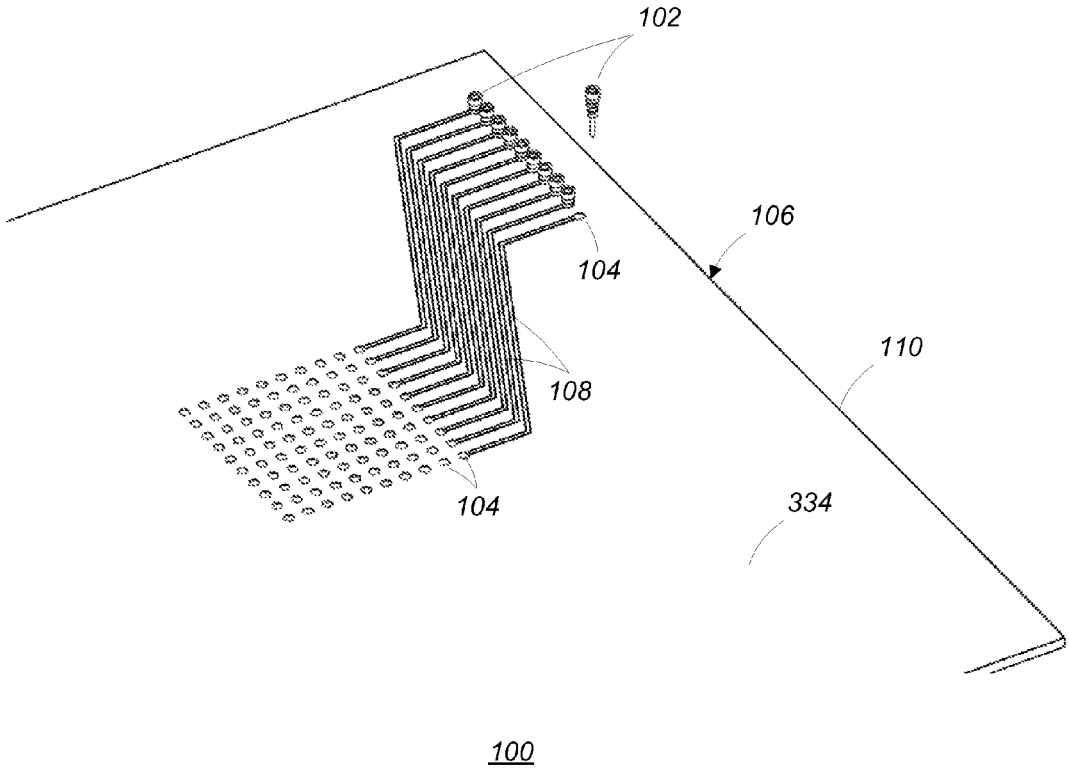
FIG. 1 is a perspective view of a printed circuit board including a plurality of terminals including compliant barbs press fit into plated through holes.
Figure 3:
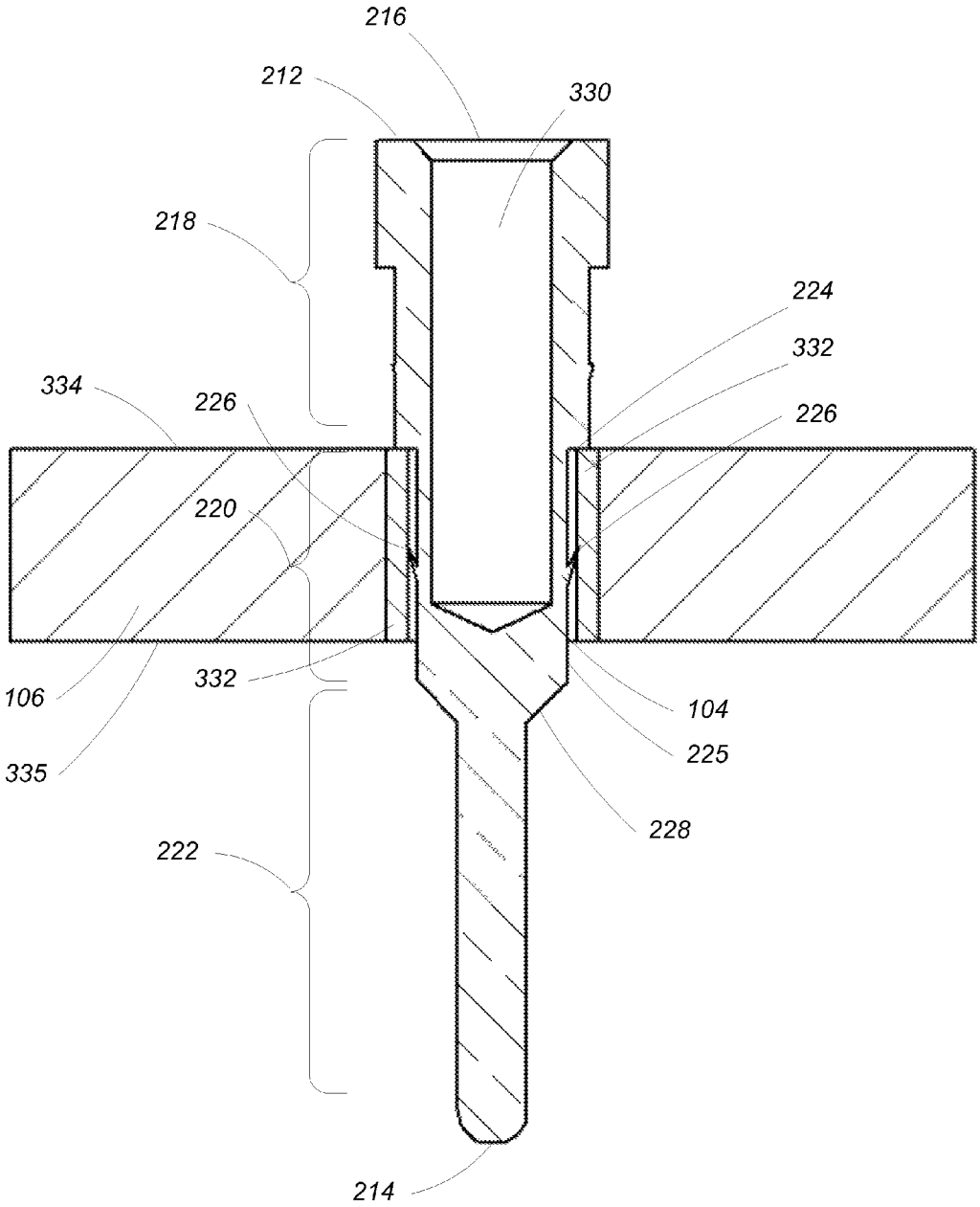
FIG. 3 is a cross sectional view of the terminal of FIG. 1 inserted into a plated through hole in a printed circuit board.

FIG. 1 shows an assembly 100 of a plurality of terminals 102 in a printed circuit board (PCB) 106 that is configured to accept an integrated circuit chip (not shown). The PCB 106 includes an insulated substrate 110 that is made of a dielectric material such as glass fiber epoxy laminate with a thickness that is dictated by the specific application in which the PCB 106 is used. The PCB 106 includes a first surface 334 and a second surface 335 (the second surface is shown in FIG. 3). Each of the terminals 102 are press fitted into a plurality of through holes 104. The through holes 104 are cylindrical and extend through the PCB 106 in a direction from the first surface 334 to the second surface 335. The through holes 104 are formed by punching or drilling holes in the insulative substrate 110 and include an inner surface that is covered with a conductive plating material 332 such as copper that is in electrical contact with one of a plurality of conductive traces 108.

In some examples, the conductive traces 108 are created by bonding a layer of metal such as copper to one or both sides of the insulative substrate 110. A layer of etch resistant material is then deposited on the layer of copper in a pattern representing the desired layout of the conductive traces 108. An etching material is then used to remove the areas of the copper layer that are not covered by the etch resistant material, resulting in the formation of the conductive traces 108. The conductive traces 108 extend along the surface of the insulative substrate 110, and between the through holes 104 for the purpose of connecting the through holes 104 to each other. In other examples, conductive traces can be formed within the insulative substrate 110.

In some examples, two or more traces 108 can connect to a single through hole 104. In other examples, a single trace can connect to two or more through holes 104. It is understood that the particular configuration of the traces 108 depends on the requirements of the specific application.

Figure 2:
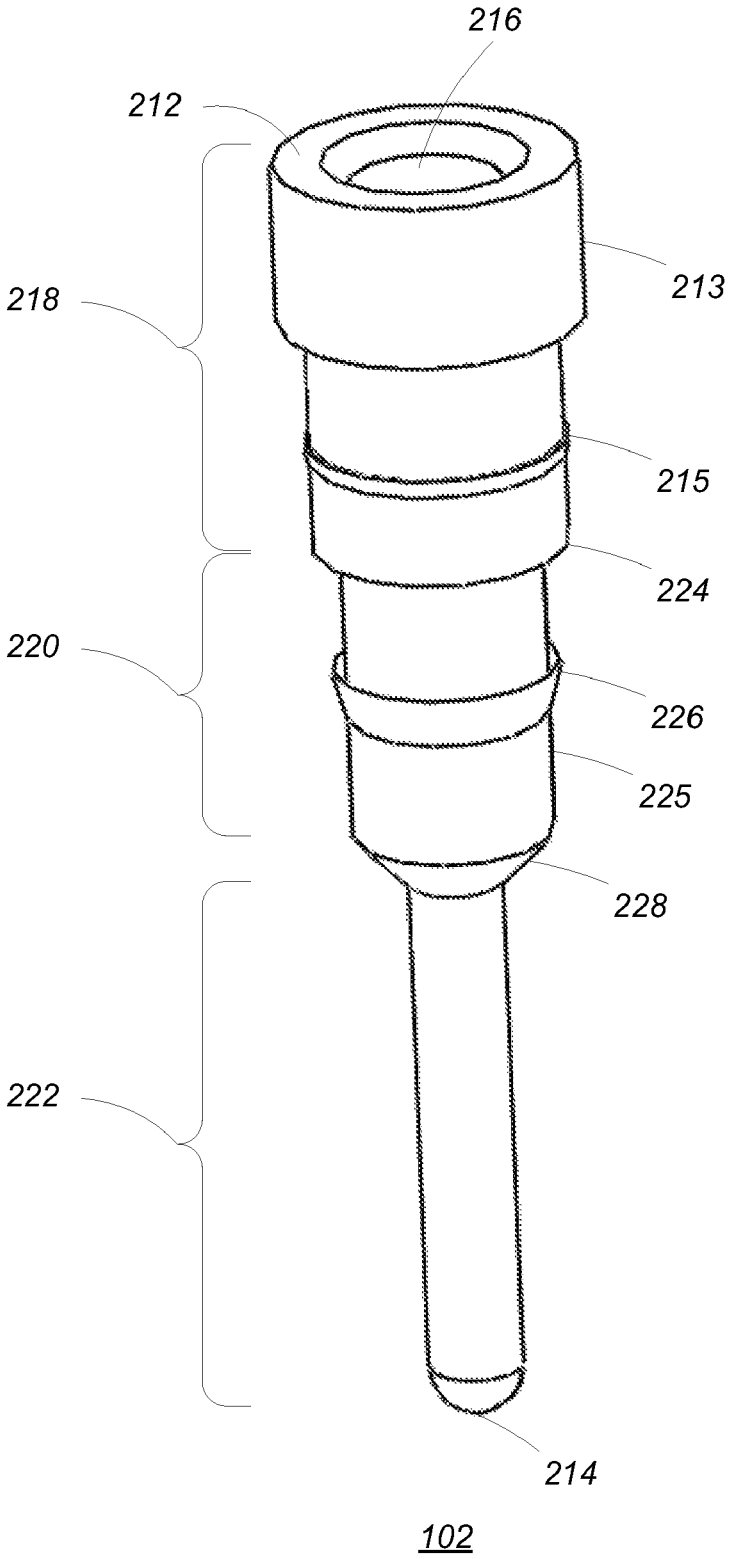
FIG. 2 is a perspective view of a terminal of FIG. 1.

Referring to FIG. 2, the terminal 102 is substantially cylindrical and extends from a proximal end 212 to a distal end 214. The proximal end 212 includes a circular opening 216 that serves as an entrance to a cylindrical void 330 (shown in FIG. 3) that extends along part of the length of the terminal 102 in a direction from the proximal end 212 to the distal end 214. In some embodiments, the opening 216 and cylindrical void 330 are configured to accept a circular metal terminal with flexible contact fingers (not shown). The terminal 102 including the circular metal terminal inserted into the cylindrical void 330 is capable of receiving and forming an electrical connection with another terminal (e.g., a pin). In other embodiments, wires can be soldered into the cylindrical void 330.

The terminal 102 includes three generally cylindrical portions: a header portion 218, a barbed portion 220, and a pin portion 222. The header portion 218 includes the proximal end 212, extends in a direction toward the distal end 214 and is configured to interface with other components such as the pins or sockets of other connectors (not shown). The outer diameter of the header portion 218 is larger than that of the through hole 104 such that this portion of the terminal 102 remains outside of the PCB 106 when the terminal 102 is press fitted into the PCB 106. In some examples, the header portion 218 includes a header portion lip 213 and a header portion barb 215.

The header portion lip 213 serves several purposes. In some examples, the header portion lip 213 is used as a stop to ensure that the terminal 102 does not pass through the PCB 106 during installation. In other examples, the header portion lip 213 is used to maintain a separation distance between PCBs or connectors. In still other examples, the header portion lip 213 is required when a contact being installed into the terminal is larger than the hole in the PCB 106.

The header portion barb 215 is provided on the header portion between the lip 213 and the barbed portion, and may be used to facilitate retention of the terminal 102 in a carrier used to installs a grid (an array) of terminals at one time.

The barbed portion 220 is disposed between the header portion 218 and the pin portion 222, and is dimensioned to be inserted into a through hole 104 in the PCB 106 to establish a press fit. The barbed portion 220 includes a cylindrical body 225 and a compliant barb 226.

The cylindrical body 225 has a diameter that is less than the diameter of the header portion 218. The transition from the larger diameter of the header portion 218 to the smaller diameter of the cylindrical body 225 is abrupt, creating a lip 224 between the two portions. The lip 224 acts as a stop when the terminal 102 is inserted into the through hole 104 in the PCB 106, preventing the header portion 218 from entering into the through hole 104.

The compliant barb 226 is disposed on the outer surface of the cylindrical body 225 and has an annular shape that extends around the circumference of the cylindrical body 225 generally midway between the header portion 218 and the pin portion 222. When the barbed portion 220 is pressed into the through hole in the PCB, the compliant barb 226 conforms to the inner surface of the through hole, establishing an electrical connection with the plating without damaging the plating. These features are described in more detail in the descriptions of FIGS. 3 and 4.

The pin portion 222 extends from the barbed portion 220 on a side opposed to the header portion 218. The diameter of the pin portion 222 is less than the diameter of the barbed portion 220 and a bezel portion 228 provides a gradual transition between the two diameters. The pin portion 222 is cylindrical in shape and terminates in a rounded distal end 214 of the terminal 102. The pin portion 222 is configured to extend below the PCB 106 and to be inserted into another terminal such as a socket (not shown).

Referring to FIG. 3, a cross section of the previously described terminal 102 assembled (e.g., by press fitting) into a PCB 106 is shown. The terminal 102 resides in the through hole 104 such that the header portion 218 is positioned external to the PCB 106 due to the lip 224 making contact with the first surface 334 of the PCB 106 and preventing the terminal 102 from entering further into the through hole 104. The cross section shows that the opening 216 of the terminal 102 leads into a void 330 that is configured to accept, for example, a circular metal terminal with metal contact fingers.

The majority of the barbed portion 220 of the terminal 102 lies within the through hole 104. The diameter of the compliant barb 226 when uncompressed is greater than the diameter of the through hole 104. The diameter of the cylindrical body 225 of the barbed portion 220 is less than the diameter of the through hole 104. When the barbed portion 220 is pressed into the through hole 104, the cylindrical body 225 is easily accommodated by the through hole 104. However, since the diameter of the compliant barb 226 is greater than the diameter of the through hole 104, the compliant barb 226 is compressed inward toward the center of the terminal 102 by contact with the plating 332 of the through hole 104. This compression causes the diameter of the compliant barb 226 to conform to the diameter of the through hole 104. This conformance establishes an electrical connection between the compliant barb 226 and the plating 332 on the inner surface of the through hole 104. The compliance of the barb 226 allows for insertion of the barbed portion 220 of the terminal 102 without damaging the plating 332 of the through hole 104 as would occur if the barb 226 were rigid.

Figure 4:
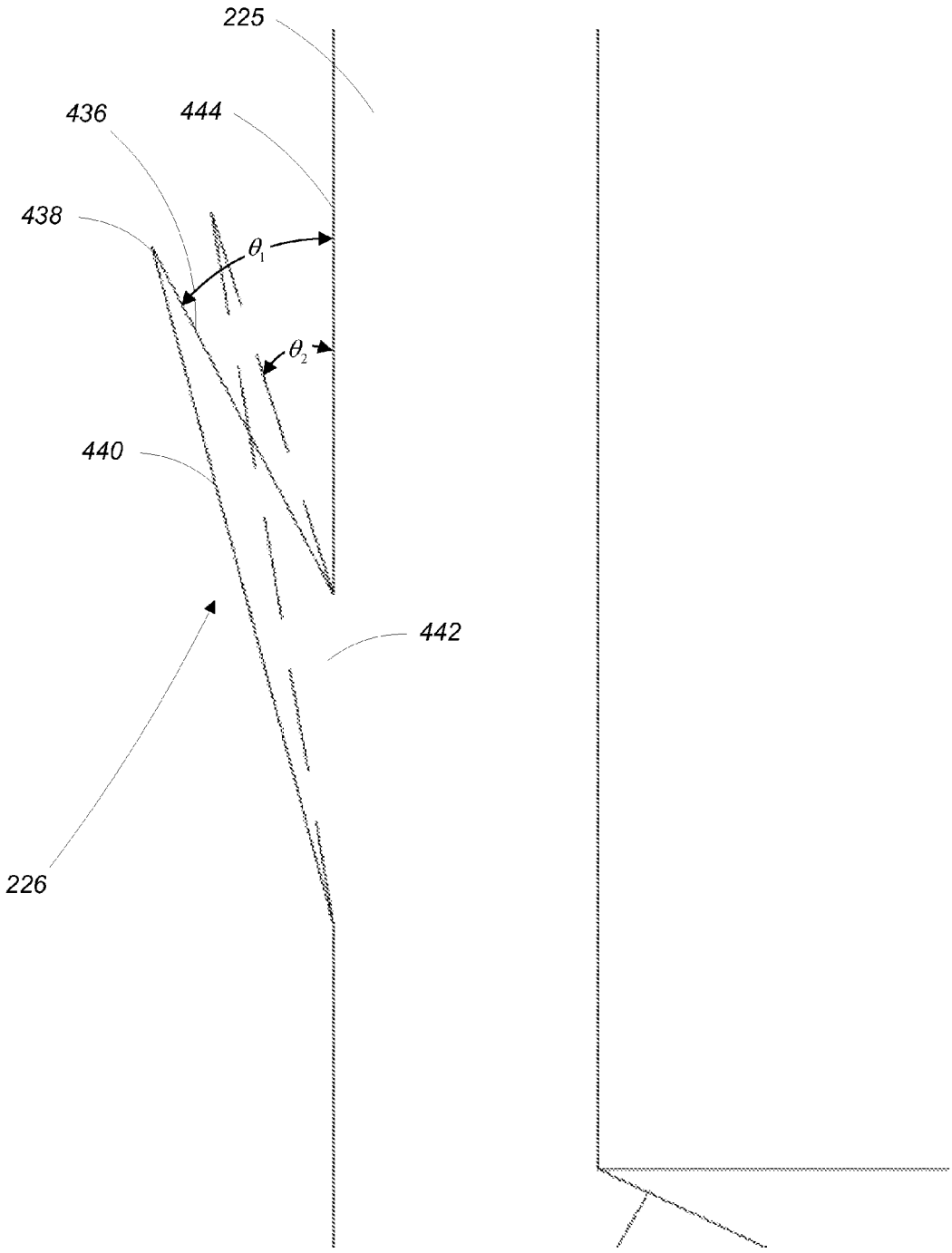
FIG. 4 is a magnified cross sectional view of the compliant barb of FIGS. 1-3 in an uncompressed state (solid line) and a compressed state (broken line).

Referring to FIG. 4, the compliant barb 226 includes a base portion 442 disposed on an outer surface 444 of the cylindrical body 225 of the barbed portion 220. The barb 226 also includes a flat barb inner surface 436 that faces toward the outer surface 444 of the cylindrical body 225 and a flat barb outer surface 440 that faces away from the outer surface 444 of the cylindrical body 225. When viewed in cross section, the flat barb inner surface 436 and flat barb outer surface 440 are linear.

When the barb 226 is in an uncompressed state (i.e., before insertion in the through hole 104 and shown with solid lines in FIG. 4), the inner surface 436 lies at an acute angle $\theta_1$ from the outer surface 444 of the cylindrical body 225. An apex portion 438 is formed at the convergence of the barb inner surface 436 and the barb outer surface 440, creating a barb 226 with a non-uniform cross section. The apex 438 extends away from the base portion 442 so as to extend in a direction from the distal end 214 of the terminal 102 to the proximal end 212 of the terminal 102. The apex 438 is located between the base portion 442 and the proximal end 212 of the terminal 102.

When the terminal 102 is mounted into the through hole 104, the compliant barb 226 deforms to accommodate the inner diameter of the plating 332. In the compressed state (i.e., after insertion into the through hole 104 and shown in broken lines in FIG. 4), the inner and outer barb surfaces 436, 440 are deformed such that the apex portion 438 is moved inward toward the outer surface 444 of the cylindrical body 225. When viewed in cross section, the deformation of the barb 226 causes the barb inner surface 436 and the barb outer surface 440 to be curved. In its compressed state, the angle between the barb 226 and the outer surface 444 of the cylindrical body 225 is reduced to $\theta_2$. Due to its shape, the compressed barb 226 exerts force in a direction away from the outer surface 444 of the cylindrical body 225, thereby maintaining electrical contact with the aforementioned through hole plating 332.

In some embodiments, the barb 226 is formed as a single piece with the barb portion 220, and the compliant property of the barb is achieved through providing the particular barb shape. Although the material selected can be used to enhance elasticity of the barb, its compliant properties do not depend on any particular material, but instead are related to its shape. This can be compared to some conventionally known barbs that are generally triangular in shape (e.g., having a barb inner surface that is oriented normal to the outer surface of the terminal body such that angle $\theta_1$ is 90 degrees) and are prevented from complying to the shape and size of the through hole plating 332 due to their shape and instead may damage the plating 332 during insertion.

When the barbed portion 220 is pressed into the through hole 104 as in FIG. 3, the barb 226 configuration resists removal of the terminal 102 from the through hole 104. For example, when force is applied to the terminal 102 in an attempt to remove it from the through hole 104, the apex 438 of the barb 226 cuts into the plating 332, thereby resisting the force and preventing removal of the terminal 102 from the through hole 104.

Figure 5:
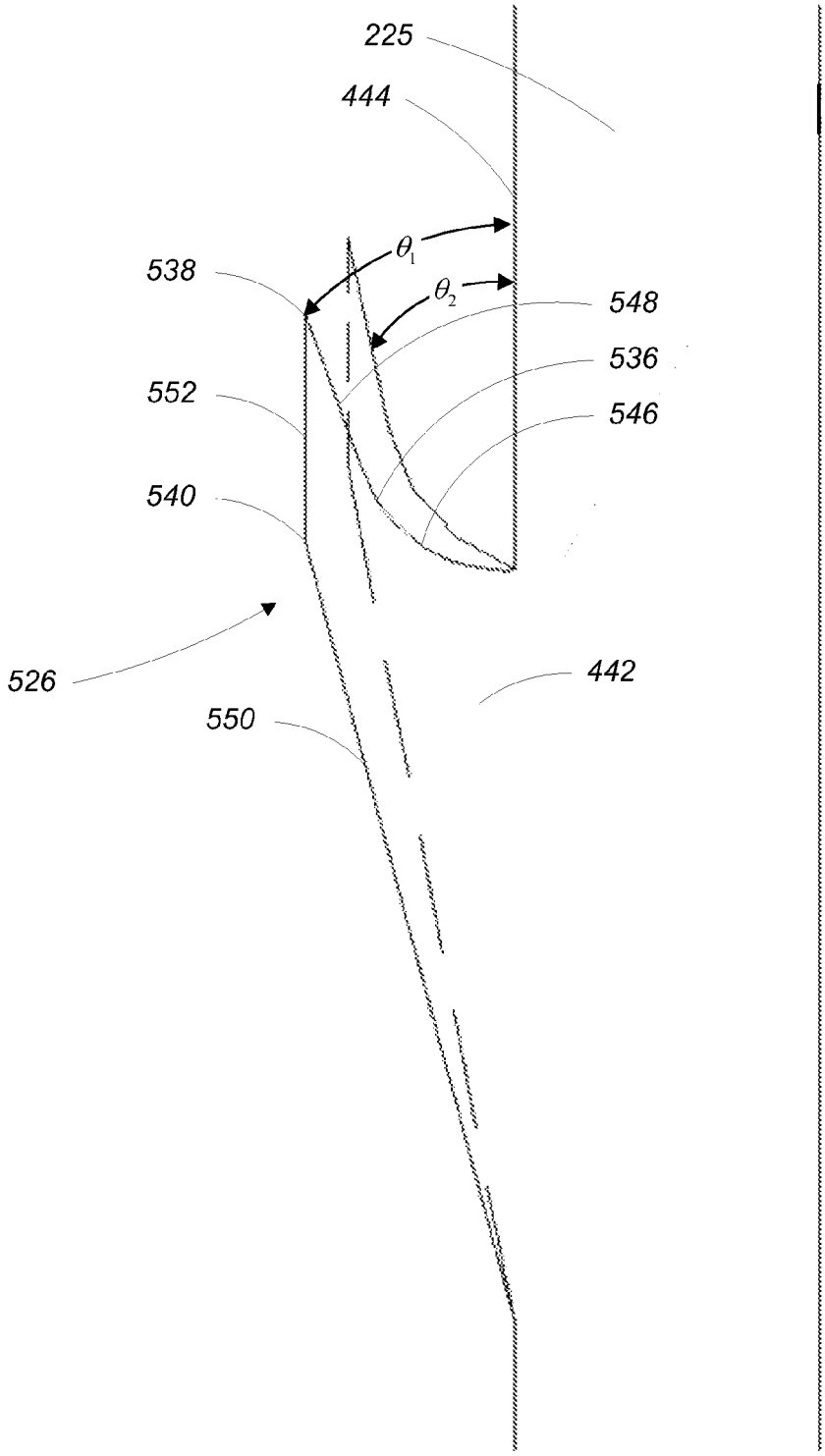
FIG. 5 is a magnified cross sectional view of another embodiment of a compliant barb in an uncompressed state (solid line) and a compressed state (broken line).

Referring to FIG. 5, another embodiment of the compliant barb 526 includes a base portion 442 disposed on an outer surface 444 of the cylindrical body 225 of the barbed portion 520, an inner surface 536 facing the outer surface 444 of the cylindrical body 225, and an outer surface 540 facing away from the outer surface 444 of the cylindrical body 225. The inner surface 536 and the outer surface 540 converge to an apex 538 which extends away from the base portion 442 and in a direction from the distal end 214 of the terminal 102 to the proximal end 212 of the terminal 102. The apex 538 is located between the base portion 442 and the proximal end 212 of the terminal 102.

The inner surface 536 includes a curved portion 546 and a generally flat portion 548. The curved portion 546 extends from the base 442 in a direction from the distal end 214 to the proximal end 212 and has a semi-circular shape. In an uncompressed state (shown with solid lines), the flat portion 548 extends from the end of the curved portion 546 and away from the outer surface 444 of the cylindrical body 225 at an angle $\theta_1$.

The outer surface 540 includes a first generally flat portion 550 and a second generally flat portion 552. The first flat portion 550 extends from the base 442 at an angle substantially the same as $\theta_1$. The second flat portion 552 extends from the end of the first flat portion 550 and at an angle that is slightly away from the outer surface 444 of the cylindrical body 225. The second flat portion 552 is configured to increase the surface area between the through hole plating and the barb 526 when the barb 526 is in the compressed state.

In the compressed state of the barb 526 (shown with broken lines), the inner and outer barb surfaces 536, 540 are deformed such that the apex portion 538 is moved inward toward the outer surface 444 of the cylindrical body 225. In its compressed state, the angle between the barb 526 and the outer surface 444 of the cylindrical body 225 is reduced to $\theta_2$. Due to its shape, the compressed barb exerts force in a direction away from the outer surface of the cylindrical body 225, maintaining electrical contact with the aforementioned through hole plating. As was previously mentioned, the second flat portion 552 is configured such that a greater amount of barb 526 surface area is in electrical contact with the through hole plating when the barb 526 is in the compressed state.

A method for forming the previously described terminals includes first providing a portion of conductive material such as brass, beryllium copper, or phosphor bronze, for example, as a bar stock. The bar stock is shaped such that a cutting tool can be used to form the terminal by removing material from the bar stock to generate a desired shape in a turning or milling process. The tool is used to remove material so as to provide a terminal having the shape of the compliant barb described above.

Figure 6:
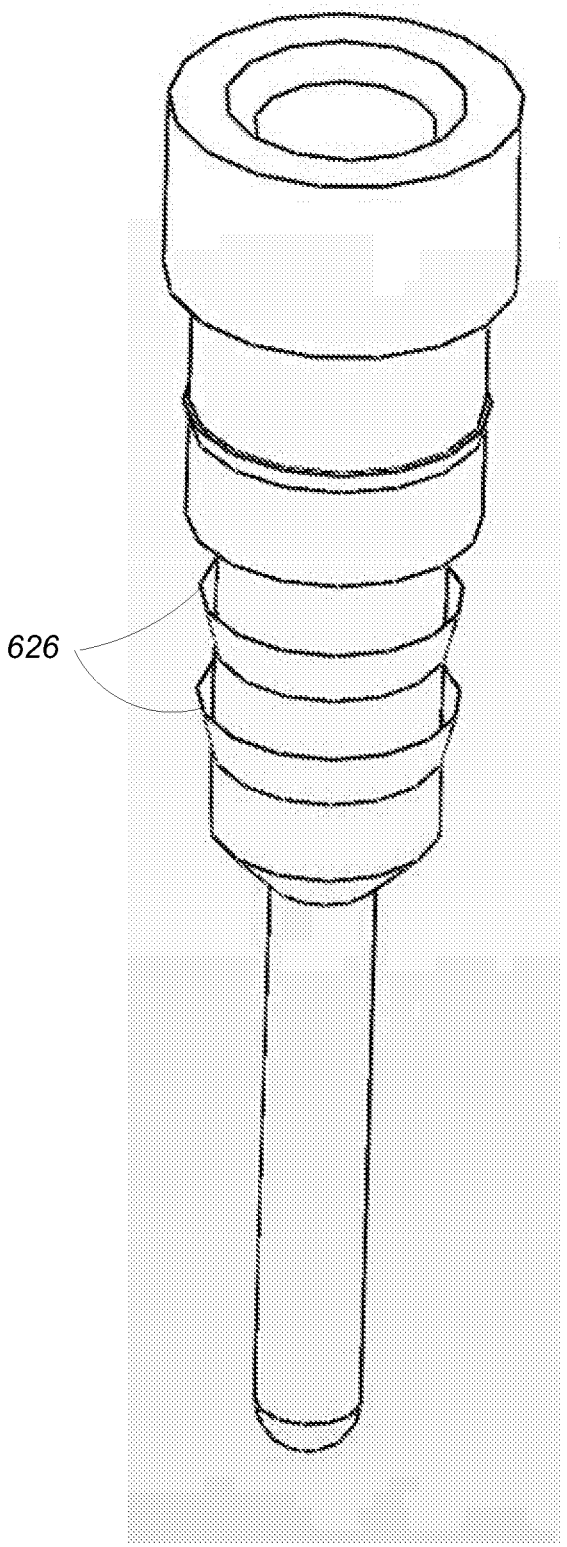
FIG. 6 is a perspective view of another embodiment of a terminal.

Referring to FIG. 6, an alternative terminal 602 is configured in substantially the same manner as the terminal 102 of FIG. 1. However, instead of having a single barb disposed on the cylindrical body 225 of the barbed portion 220, two barbs 626 are disposed on the cylindrical body. This type of terminal 602 is used, for example, when a more secure press fit is required.

Figure 7:
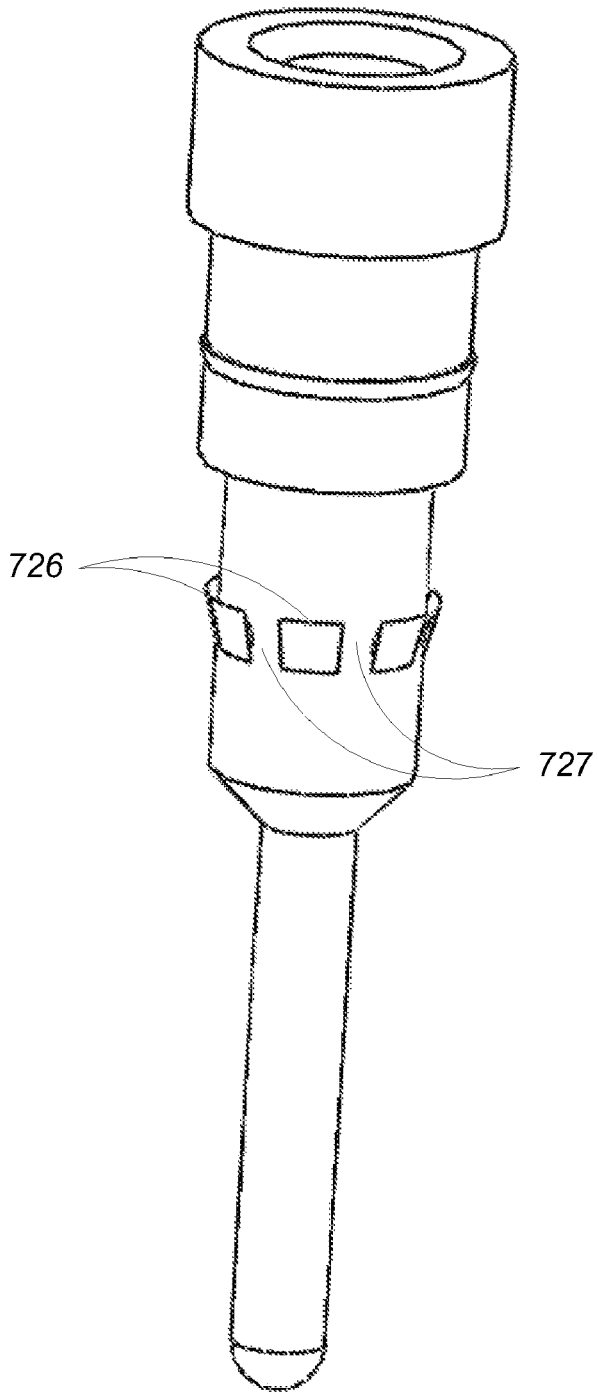
FIG. 7 is a perspective view of another embodiment of a terminal.

Referring to FIG. 7, another alternative terminal is configured in substantially the same manner as the 102 of FIG. 1. However, instead of having a single, annular barb extending around the circumference of the cylindrical body 225 of the barbed portion 220, a plurality of individual barbs 726 separated by gaps 727 protrude from the cylindrical body 225. In some embodiments, barbs 726 are equidistantly spaced about the circumference.

Figure 8:
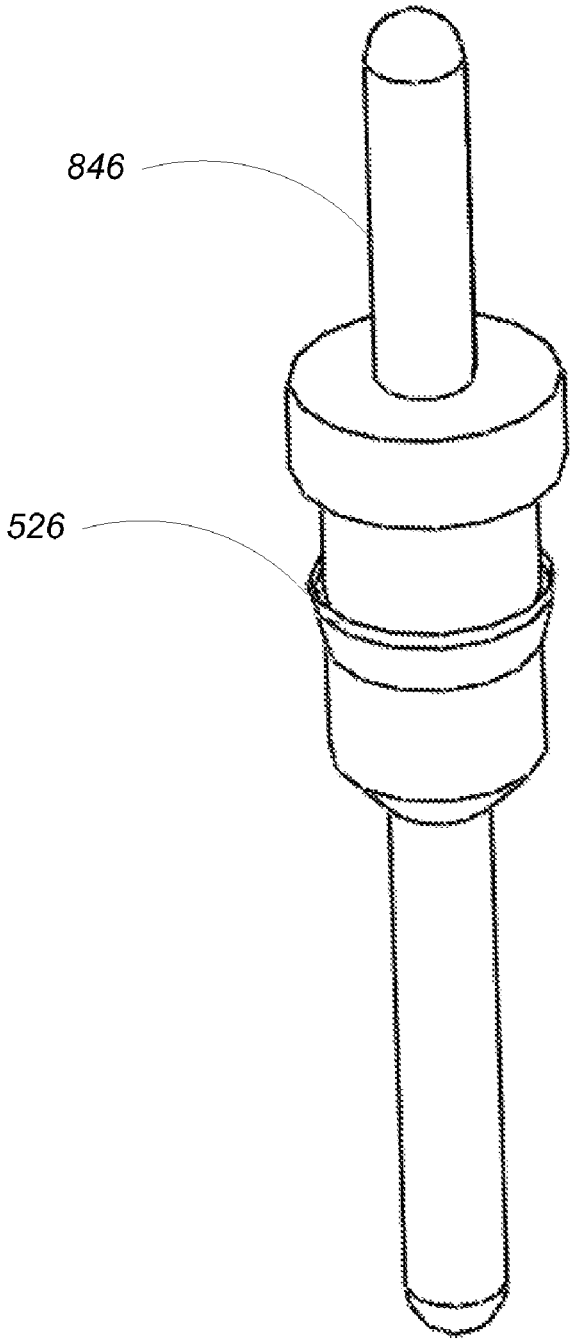
FIG. 8 is a perspective view of another embodiment of a terminal.

Referring to FIG. 8, another alternative terminal is configured in substantially the same manner as the terminal 102 of FIG. 1 including the barb 526 of FIG. 5. However, instead of including a void configured to accept a pin, the terminal 802 includes a second pin portion 846 that is configured to be inserted into a socket terminal (not shown).

It is to be understood that the foregoing description is intended to illustrate and not to limit the scope of the invention, which is defined by the scope of the appended claims. Other embodiments are within the scope of the following claims.

What is claimed is:

1. An electrically conductive terminal for insertion into an opening of a substrate, the terminal comprising:

a body having a proximal end and a distal end, the distal end configured for insertion into the opening, the body including:

a wall having an outer surface;

a compliant barb including:

a base portion disposed on the outer surface of the wall and along the body; and an apex portion extending away from the base portion in a direction from the distal end to the proximal end and at an angle from the wall outer surface, such that the apex is located between the base and the proximal end;

a barb inner surface facing the wall outer surface;

a barb outer surface;

wherein when the barb is viewed in cross-section, the barb inner surface and the barb outer surface converge to the apex so that the cross-sectional width of the barb is non-uniform.

2. The electrically conductive terminal of claim 1, wherein the barb inner surface and the barb outer surface are linear when viewed in cross section.

3. The electrically conductive terminal of claim 1, wherein the barb outer surface is substantially linear and the barb inner surface is substantially semi-circular when viewed in cross section.

4. The electrically conductive terminal of claim 1, wherein the barb is annular.

5. The electrically conductive terminal of claim 1, wherein the terminal includes a plurality of discrete barbs along a circumference of the terminal.

6. The electrically conductive terminal of claim 1, wherein the terminal includes a pin portion formed on the proximal end.

7. The electrically conductive terminal of claim 6, wherein the terminal includes a pin portion formed on the distal end.

8. The electrically conductive terminal of claim 1, wherein the terminal includes a socket portion formed on the proximal end.

9. The electrically conductive terminal of claim 8, wherein the terminal includes a pin portion formed on the distal end.

10. The electrically conductive terminal of claim 1 wherein the terminal includes a substantially cylindrical header portion formed at the proximal end, a substantially cylindrical pin portion formed at the distal end, and a substantially cylindrical barbed portion connecting the header portion and the pin portion, and the barbed portion includes the compliant barb.

11. The electrically conductive terminal of claim 1 wherein, prior to insertion of the terminal into the opening of the substrate, the barb inner surface and the wall outer surface form a first angle, and after insertion of the terminal into the opening of the substrate, the barb inner surface and the wall outer surface form a second angle, less than the first angle.

12. A terminal assembly comprising:

a substrate;

an opening in the substrate including an opening inner surface;

an electrically conductive terminal inserted into the opening of the substrate, the terminal including:

a body having a proximal end and a distal end, the distal end configured for insertion into the opening, the body including:

a wall having an outer surface;

a compliant barb including:

a base portion disposed on the outer surface of the wall and along the body; and an apex portion extending away from the base portion in a direction from the distal end to the proximal end and at an angle from the wall outer surface, such that the apex is located between the base and the proximal end;

a barb inner surface facing the wall outer surface;

a barb outer surface;

wherein when the barb is viewed in cross-section, the barb inner surface and the barb outer surface converge to the apex so that the cross-sectional width of the barb is non-uniform.

13. The terminal assembly of claim 12 wherein the barb outer surface contacts the opening inner surface, creating a compressive fit.

14. The terminal assembly of claim 12 wherein the barb is configured to create a compressive fit by conforming to the shape and dimensions of the opening inner surface.

* * * * *